US009278251B2

(12) United States Patent
Decca

(10) Patent No.: US 9,278,251 B2
(45) Date of Patent: Mar. 8, 2016

(54) COMPACT STATIONARY BICYCLE

(71) Applicant: Anghel Decca, Los Angeles, CA (US)

(72) Inventor: Anghel Decca, Los Angeles, CA (US)

( * ) Notice: Subject to any disclaimer, the term of this patent is extended or adjusted under 35 U.S.C. 154(b) by 151 days.

(21) Appl. No.: 14/224,324

(22) Filed: Mar. 25, 2014

(65) Prior Publication Data

US 2014/0287883 A1 Sep. 25, 2014

Related U.S. Application Data

(60) Provisional application No. 61/804,874, filed on Mar. 25, 2013.

(51) Int. Cl.

| | |
|---|---|
| ***A63B 22/06*** | (2006.01) |
| ***A63B 69/16*** | (2006.01) |
| ***A63B 21/005*** | (2006.01) |
| ***A63B 21/22*** | (2006.01) |
| ***A63B 21/00*** | (2006.01) |

(52) U.S. Cl.

CPC ..... *A63B 22/0694* (2013.01); *A63B 21/0051* (2013.01); *A63B 21/00069* (2013.01); *A63B 21/1609* (2015.10); *A63B 21/225* (2013.01); *A63B 22/0605* (2013.01); *A63B 2220/17* (2013.01)

(58) Field of Classification Search

CPC ..... A63B 21/00069; A63B 21/00192; A63B 21/005; A63B 21/0051; A63B 21/0052; A63B 22/0605; A63B 22/0694; A63B 2210/02; A63B 2210/58

See application file for complete search history.

(56) References Cited

U.S. PATENT DOCUMENTS

| | | | | |
|---|---|---|---|---|
| 4,222,376 | A * | 9/1980 | Praprotnik | 601/24 |
| 4,262,902 | A * | 4/1981 | Dranselka | 482/60 |
| 4,822,032 | A * | 4/1989 | Whitmore et al. | 482/63 |
| 5,807,212 | A * | 9/1998 | Nelson | 482/60 |
| 7,648,447 | B2 * | 1/2010 | Andre | 482/60 |
| 8,512,210 | B2 * | 8/2013 | Shauli | 482/8 |

* cited by examiner

*Primary Examiner* — Oren Ginsberg

(74) *Attorney, Agent, or Firm* — Plager Schack LLP

(57) ABSTRACT

A compact stationary bicycle is configured to fit beneath a desk. The compact stationary bicycle has a silent drive assembly, configured to be driven by a user. A casing is mechanically coupled to the silent drive assembly. An attachment assembly is mechanically coupled to the casing and configured to attach the casing to a chair occupied by the user putting the silent drive assembly well forward of knees of the user. The user of any height can drive the silent drive assembly beneath the desk without contacting the knees with the desk.

8 Claims, 4 Drawing Sheets

COMPACT STATIONARY BICYCLE

RELATED APPLICATION

This application claims priority to provisional patent application U.S. Ser. No. 61/804,874 filed on Mar. 25, 2013, the entire contents of which is herein incorporated by reference.

BACKGROUND

The embodiments herein relate generally to devices that a user can utilize for personal exercise.

Prior to the disclosed invention there was no stationary bicycle that could fit underneath a standard desk having a standard desk height and be used by a user of any height. As used in this application, The standard desk height is between 28½" and 29½". Embodiments of the present invention solve this problem.

SUMMARY

A compact stationary bicycle is configured to fit beneath a desk. The compact stationary bicycle has a silent drive assembly, configured to be driven by a user. A casing is mechanically coupled to the silent drive assembly. An attachment assembly is mechanically coupled to the casing and configured to attach the casing to a chair occupied by the user putting the silent drive assembly well forward of knees of the user. The user of any height can drive the silent drive assembly beneath the desk without contacting the knees with the desk.

In some embodiments, the casing further comprises a left outer panel mechanically coupled to a right outer panel with an upper rear panel spacer, an upper front panel spacer, a lower rear panel spacer and a lower front panel spacer. The lower front panel spacer further comprises a lower front panel spacer locking pin hole configured to receive the attachment assembly.

In some embodiments, the attachment assembly further comprises an attachment plate further comprising attachment locking pin holes, an attachment notch and an upper wheel trap. A lower wheel trap adjustably connected to the attachment plate with a first locking pin. The upper wheel trap and the lower wheel trap are configured to fit tightly in front and behind a caster or a wheel on the chair.

In some embodiments, the silent drive assembly further comprises a resistance disk, mechanically coupled to a first small pulley with spacers. A first large pulley is connected to the first small pulley with a first belt. A second small pulley is mechanically coupled to the first large pulley. A second large pulley is connected to the second small pulley with a second belt. A third small pulley is mechanically coupled to the second large pulley. A third large pulley is connected to the third small pulley with a third belt.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
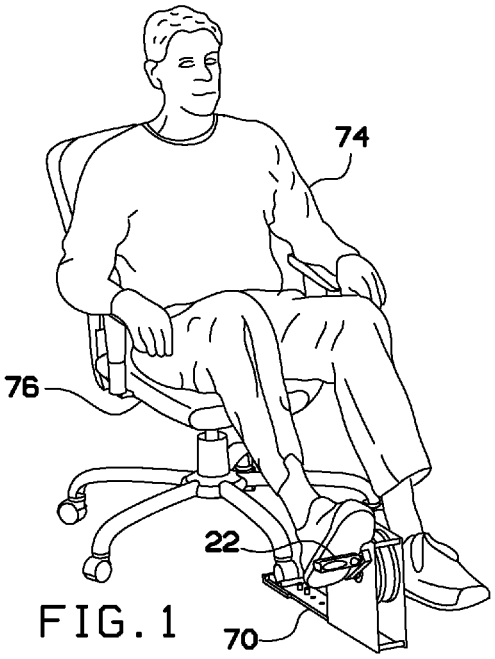
FIG. 1 is a perspective view of an embodiment of the invention shown in use.

By way of example, FIG. 1, shows user 74 who desires to sit in chair 76 and exercise. User 74 can accomplish this with a compact stationary bicycle.

Figure 2:
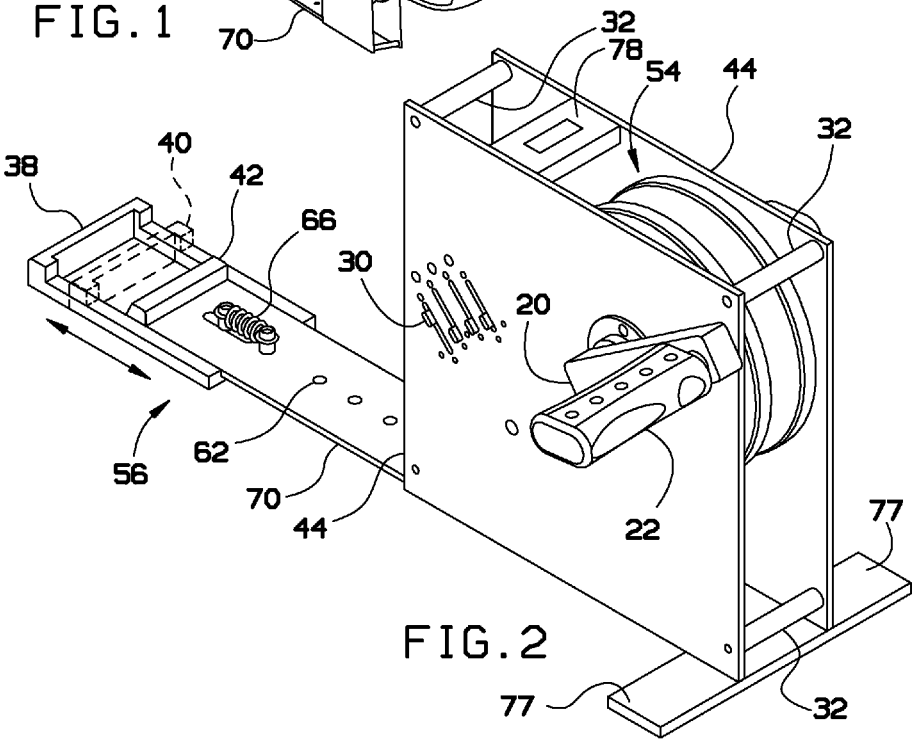
FIG. 2 is a front perspective view of an embodiment of the invention.
Figure 3:
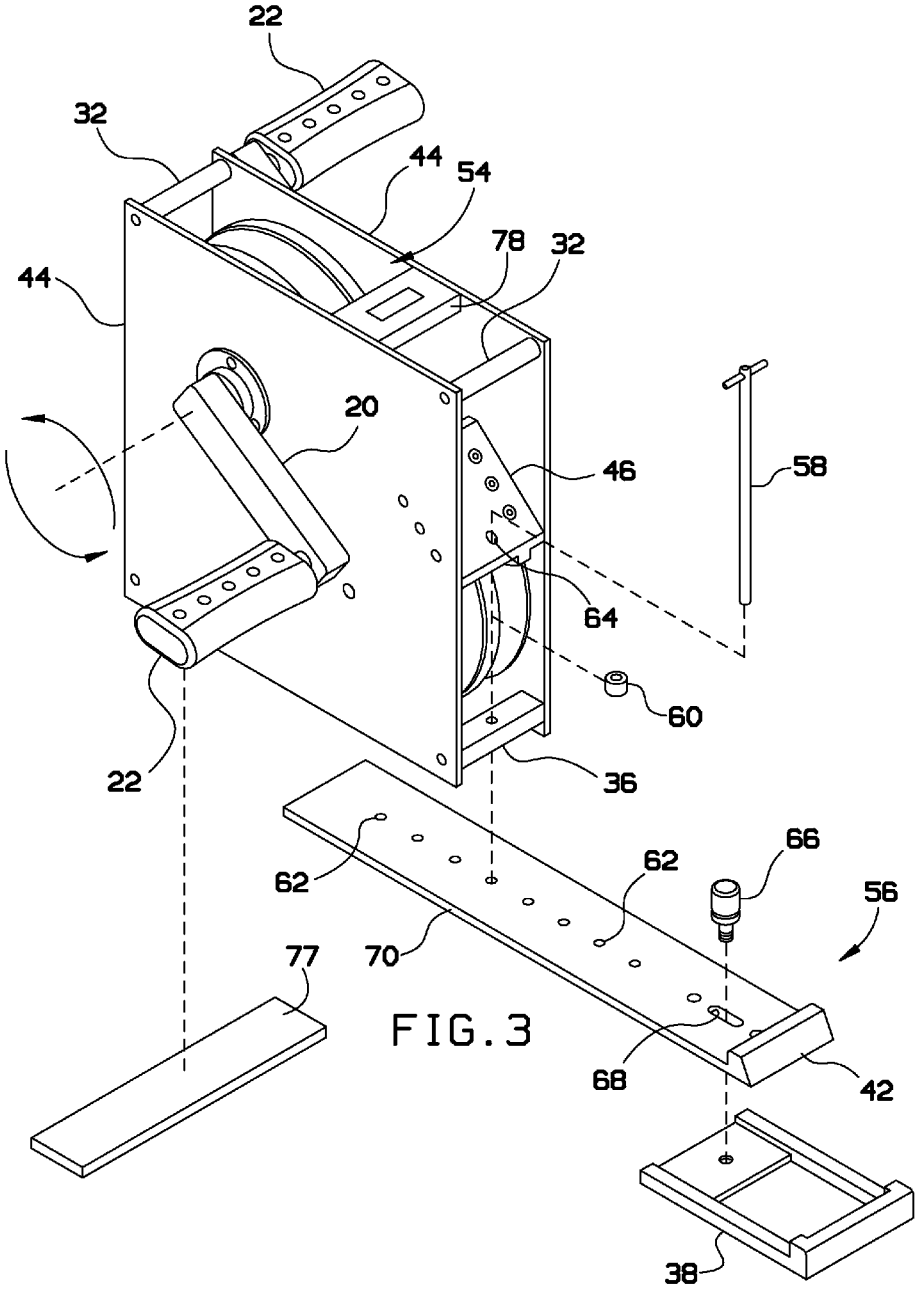
FIG. 3 is a rear perspective view of an embodiment of the invention.

As shown in FIG. 2 and FIG. 3 the improved stationary bicycle comprises silent drive assembly 54 mechanically coupled to left outer panel 44 and right outer panel 44. Left outer panel 44 is mechanically coupled to right outer panel 44 with upper rear panel spacer 32, upper front panel spacer 32, lower rear panel spacer 32 and lower front panel spacer 36. Left outer panel 44 is further mechanically coupled to left base plate 77. Likewise, right outer panel 44 is further mechanically coupled to right base plate 77. Left base plate 77 and right base plate 77 increase the stability of the casing by preventing forces orthogonal to left outer panel 44 and right outer panel 44 from causing the casing to tip over. Lower front panel spacer 36 comprises a lower front panel spacer locking pin hole. Collectively, this is the casing which is shown in more detail in FIG. 4.

Silent drive assembly 54 is mechanically coupled to left crank 20 and right crank 20. Left crank 20 is mechanically coupled to left pedal 22 with left drive shaft bearing housing 34. Likewise, right crank 20 is mechanically coupled to right pedal 22 with right drive shaft bearing housing 34. As shown in more detail in FIG. 4 and FIG. 5, silent drive assembly 54 is mechanically coupled to the casing and a pair of pedals.

The casing is mechanically coupled to attachment assembly 56 in the following manner. Attachment assembly 56 comprises attachment plate 70. Attachment plate 70 further comprises attachment locking pin holes 62, attachment notch 68 and upper wheel trap 42. A user can place a wheel or a caster on top of the lower wheel trap 38 and upper wheel trap 42 and, as a result, spring 66 under the vertical pressure will automatically extend to adjust the spacing between lower wheel trap 38 and upper wheel trap 42 to fit tightly in front and behind the caster or wheel. The weight of the user sitting in the chair holds the stationary bicycle in a locked position relative to the chair. Locking pin 58 allows the user to adjust the distance between the silent drive assembly and chair 76 by sliding attachment plate 70 in or out of the silent drive assembly.

This configuration is a substantial distinction from prior art bicycles which fit under desks that require a use to have one's knees aligned roughly above the pedals. This made it impossible for a user over seventy inches in height to use the device at all without either banging one's knees into a standard sized table or requiring a custom built table for this purpose. The present invention solves this problem by moving the bicycle forward.

Figure 4:
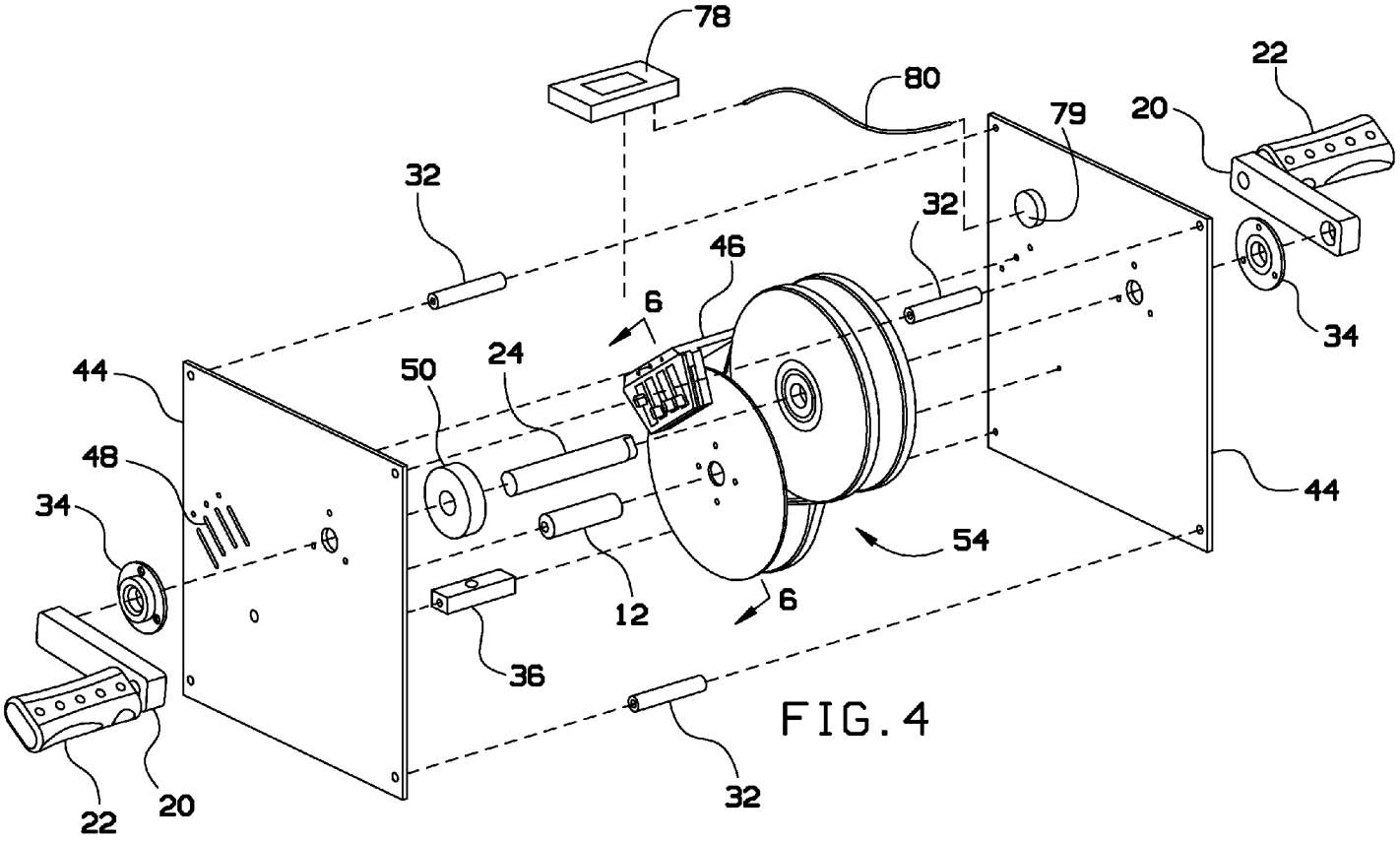
FIG. 4 is an exploded perspective view of an embodiment of the invention shown with fasteners removed for clarity.

FIG. 4 shows the casing in more detail. Drive shaft 24 is immediately adjacent to drive shaft pulley spacer 50, silent drive assembly 54, left outer panel 44, left drive shaft bearing housing 34, right outer panel 44 and right drive shaft bearing housing 34. Drive shaft 24 is mechanically coupled to left crank 20 and right crank 20. Right outer panel 44 comprises sliding magnet slots 48 which can accommodate magnetic resistance module 46 which is shown in more detail in FIG. 6 and FIG. 7. Resistance disk 26, first small pulley 16, second large pulley 14 and third small pulley 16 are immediately adjacent to axel 12 which is mechanically coupled to left outer plate 44 and right outer plate 44 as shown in some detail in FIG. 5.

Left outer plate 44 is mechanically coupled to sensor 79. Sensor 79 is electrically coupled to odometer 78. Sensor 79 is configured to count every time fixed large pulley 10 rotates. When this occurs an electrical signal is sent to odometer 79 which tracks the number of rotations of fixed large pulley 10.

Figure 5:
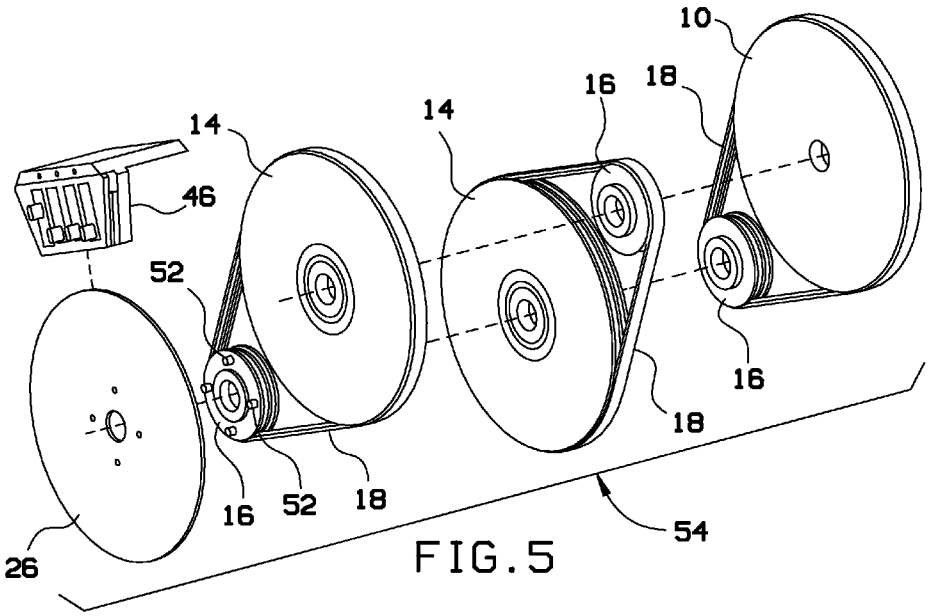
FIG. 5 is a detailed exploded perspective view of an embodiment of the invention showing the silent drive assembly.

FIG. 5 shows an exploded view of silent drive assembly 54. Silent drive assembly 54 comprises resistance disk 26. Resistance disk 26 is mechanically coupled to first small pulley 16 with spacers 52. First small pulley 16 is mechanically coupled to first large pulley 14 by first belt 18. First large pulley 14 is mechanically coupled to second small pulley 16. Second small pulley 16 is mechanically coupled to second large pulley 14 by second belt 18. Second large pulley 18 is mechanically coupled to third small pulley 16. Third small pulley 16 is mechanically coupled to third large pulley 10 by third belt 18. In this manner, as a user exerts force on pedal 22 to turn crank 20 and thus drive shaft 24. This causes large pulleys 14 and small pulleys 16 to rotate. However, a user can increase resistance by adjusting magnetic resistance module 46 as shown in FIG. 6 and FIG. 7.

Figure 6:
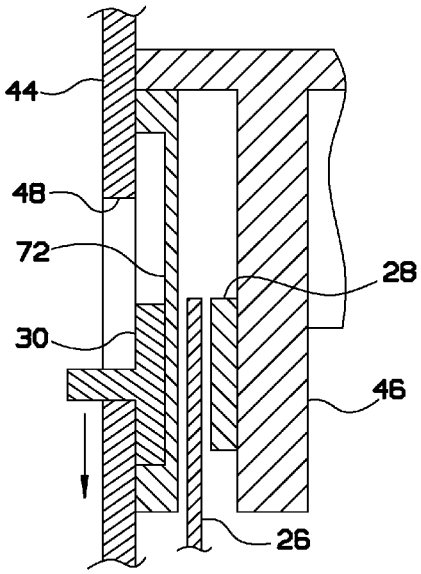
FIG. 6 is a detailed section view of an embodiment of the invention taken along line 6-6 in FIG. 4 showing the magnetic resistance module with the sliding magnets with tabs in the down/on position.
Figure 7:
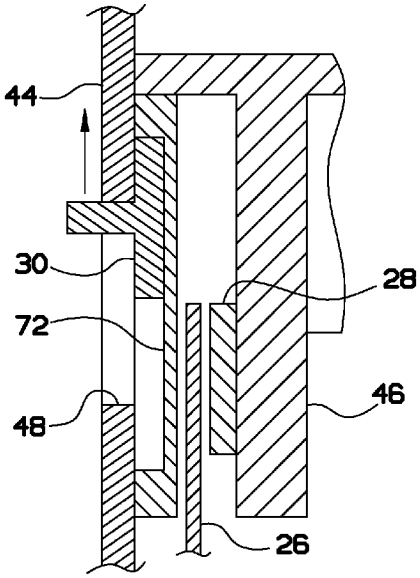
FIG. 7 is a detailed section view of an embodiment of the invention showing the magnetic resistance module with the sliding magnets with tabs in the up/off position.

FIG. 6 and FIG. 7 show magnetic resistance module 46 in more detail. Right outer panel 44 is comprises sliding magnet slots 48 as noted above. Sliding magnet 30 is immediately adjacent to magnet outer plate 72 and can slide freely along magnet outer plate 72 being either proximate resistance disk 26 (FIG. 6) or distant resistance disk 26 (FIG. 7). When proximate resistance disk 26, sliding magnet 30 exerts a magnetic force onto resistance disc 26 inducing Eddie currents which create a magnetic opposing force in resistance disk 26. Alternately, when distant resistance disk 26, sliding magnet 30 ceases to induce Eddie currents in disk 26 decreasing the resistance.

While any components can be made of known materials in known manners, it is preferable to make resistance disk 26 and outer panels 44 from aluminum or some other nonferrous metal to avoid magnetizing these components. Large pulleys 14 and small pulleys 16 can be multiple immediately adjacent pulleys affixed with pressed bearings depending on user preference.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A compact stationary bicycle configured to fit beneath a desk having a standard desk height, the compact stationary bicycle comprising:

a silent drive assembly, configured to be driven by a user;

a casing, mechanically coupled to the silent drive assembly;

an attachment assembly, mechanically coupled to the casing and configured to attach the casing to a chair occupied by the user putting the silent drive assembly well forward of knees of the user; wherein the attachment assembly further comprises:

an attachment plate further comprising attachment locking pin holes, an attachment notch and an upper wheel trap;

a lower wheel trap adjustably connected to the attachment plate with a first locking pin;

wherein the upper wheel trap and the lower wheel trap are configured to fit tightly in front and behind a caster or a wheel on the chair;

wherein the user can drive the silent drive assembly beneath the desk without contacting the knees with the desk having the standard desk height.

2. The compact stationary bicycle of claim 1, wherein the casing further comprises a left outer panel mechanically coupled to a right outer panel with an upper rear panel spacer, an upper front panel spacer, a lower rear panel spacer and a lower front panel spacer;

wherein the lower front panel spacer further comprises a lower front panel spacer locking pin hole configured to receive the attachment assembly.

3. The compact stationary bicycle of claim 2, further comprising:

a left base plate mechanically coupled to the left outer panel; and a right base plate mechanically coupled to the right outer panel;

wherein the left base plate and the right base plate render the casing more stable by preventing forces orthogonal to the left outer panel and the right outer panel from causing the casing to tip over.

4. The compact stationary bicycle of claim 1, wherein the silent drive assembly further comprises:

a resistance disk, mechanically coupled to a first small pulley with spacers;

a first large pulley connected to the first small pulley with a first belt;

a second small pulley mechanically coupled to the first large pulley;

a second large pulley connected to the second small pulley with a second belt;

a third small pulley mechanically coupled to the second large pulley; and a third large pulley connected to the third small pulley with a third belt.

5. The compact stationary bicycle of claim 4, further comprising:

a drive shaft mechanically coupled to the first large pulley, the second small pulley and the third large pulley;

a left crank mechanically coupled to the drive shaft and further connected to a left pedal;

a right crank mechanically coupled to the drive shaft and further connected to a right pedal;

wherein rotational forces on the left pedal and the right pedal to turn the left crank and the right crank and thus rotate the drive shaft causing the large pulleys and the small pulleys to rotate.

6. The compact stationary bicycle of claim 5, wherein:

the left crank is mechanically coupled to the left pedal with a left drive shaft bearing housing; and the right crank is mechanically coupled to the right pedal with a right drive shaft bearing housing.

7. The compact stationary bicycle of claim 4, further comprising:

a magnetic resistance module connected to the resistance disk, wherein the magnetic resistance module further comprises a sliding magnet immediately adjacent to a magnet outer plate and configured to slide freely along the magnet outer plate being either proximate the resistance disk or distant the resistance disk, wherein sliding the sliding magnet increases or decreases a resistance on the resistance disk.

8. The compact stationary bicycle of claim 4, further comprising:

a left outer panel mechanically coupled to a right outer panel with an upper rear panel spacer, an upper front panel spacer, a lower rear panel spacer and a lower front panel spacer;

an axel mechanically coupled to the left outer panel and the right outer panel;

wherein the axel is immediately adjacent to and provides stability for the resistance disk, the first small pulley, the second large pulley and the third small pulley.

* * * * *